US006275205B1

(12) United States Patent
Winer

(10) Patent No.: US 6,275,205 B1
(45) Date of Patent: Aug. 14, 2001

(54) METHOD AND APPARATUS FOR DISPLAYING INFORMATION WITH AN INTEGRATED CIRCUIT DEVICE

(75) Inventor: Paul Winer, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/053,206

(22) Filed: Mar. 31, 1998

(51) Int. Cl.[7] ..... G09G 3/32
(52) U.S. Cl. ..... 345/82; 345/84
(58) Field of Search ..... 345/82, 84, 956, 345/157, 158, 174, 175, 176, 177, 162, 60; 348/96; 317/234; 178/5.4; 373/500, 501; 428/690

(56) References Cited

U.S. PATENT DOCUMENTS

| | | | | |
|---|---|---|---|---|
| 3,573,568 | * | 4/1971 | Siegel | 317/234 |
| 3,634,614 | * | 1/1972 | Geusic | 178/5.4 |
| 3,921,026 | * | 11/1975 | Konishi et al. | 313/501 |
| 4,127,792 | * | 11/1978 | Nakata | 313/500 |
| 5,541,012 | * | 7/1996 | Ohwaki et al. | 428/690 |

OTHER PUBLICATIONS

"Laser Detection and Alignment", *Phosphor Technology Web Page* at http://www.phosphor.demon.co.uk/laser.html/, updated Jun. 10, 1997.

"PixTech How Feds Work", *PixTech Web Page* at http//www.pixtech.com/howfeds.html/, updated Feb. 4, 1997.

Gail, et al: "Optical Properties of Si Based Heterostructures", *Siemens, Inc. Web Page* at http//www.cip.physik.tu–muenchen.de/tumphy/e/E24/wsi–ber/ber6.html/, updated Aug. 4, 1997.

"Up–Converting Phosphor Reports", *Phosphor Technology Web Page* at http//www–mpl–sri.com/topics/phosphor.html/, updated Jul. 31, 1997.

"Optical Materials Chart", *I.S.P. Optics Web Page* at http://www.isp.com/chartpage.html/, updated Jul. 31, 1997.

"AApnote 37–General IR and Photodetector Information", *Siemens Components, Inc., Web Page* at http//www.sci.siemens.com/siemens_new/app37/app37_1.html/, updated Feb. 4, 1998.

Palik ED: "Gallium Arsenide (GaAs)", *Handbook of Optical Constants and Solids*, pp. 429–443, Naval Research Laboratory, Washington, D.C.

Sze SM: "Physics of Semiconductor Devices", John Wiley & Sons, Inc., New York, Bell Laboratories, Inc. Murray Hill, New Jersey.

* cited by examiner

*Primary Examiner*—Steven Saras
*Assistant Examiner*—Alecia D. Nelson
(74) *Attorney, Agent, or Firm*—Blakely, Sokoloff, Taylor & Zafman LLP

(57) ABSTRACT

A method and an apparatus for displaying information such as an image with an integrated circuit. In one embodiment, a two-dimensional array of infra red light emitting diodes are disposed on a front side of a flip-chip mounted integrated circuit. The infra red light produced by each one of the light emitting diodes travels from the front side of the integrated circuit through the semiconductor substrate to the back side of the integrated circuit. A plurality of up-converting phosphors are patterned on the back side of the integrated circuit to up-convert the infra red light to visible light. In one embodiment, the up-converting phosphors up-convert the infra red light to red, green and blue visible light to produce a color display, viewable from the back side of the flip-chip mounted integrated circuit.

30 Claims, 5 Drawing Sheets

METHOD AND APPARATUS FOR DISPLAYING INFORMATION WITH AN INTEGRATED CIRCUIT DEVICE

BACKGROUND OF THE INVENTION

1. Field of the Invention

The present invention relates generally to display devices and, more specifically, the present invention relates to the display of information using integrated circuits.

2. Background Information

As technology continues to advance, electronic devices continue to become faster, smaller and more powerful. Included in this technological revolution are display devices, which are typically connected to computer devices or other electronic equipment such as for example, watches, home stereo equipment, appliances or other electronic devices.

Present day display devices used for displaying information from electronics equipment can be categorized in a number of ways. One way to categorize present day display devices is to separate the display devices into two categories. The categories are display devices that emit light directly and display devices that require an external light source.

Probably one of the best known display devices that emit light directly is the cathode ray tube (CRT) which is typically used in television displays, computer monitors or the like. CRT technology has the ability to produce bright, clear and colorful displays for viewing information. However, one disadvantage with CRT technology is that it is generally large, heavy and bulky since CRTs generally use large glass tubes to display the information.

A well-known display technology that utilizes an external light source includes liquid crystal display (LCD) technology. LCDs are commonly used in watches, notebook computer displays or other electronic devices to display information. LCD displays have the advantage of being much thinner and lighter than their CRT counterparts and are therefore much more compact and portable. However, a disadvantage with LCDs is that they are generally required to be viewed in relatively well lit environments or they require adequate back lighting.

Thus, what is desired is a display device that addresses some of the shortcomings of prior art displays discussed above. Such a display device should emit light directly, such as CRT displays, but be relatively compact, such as the LCD displays.

SUMMARY OF THE INVENTION

A display is disclosed. In one embodiment the display includes an infra red (IR) light source disposed on a front side of a semiconductor substrate of an integrated circuit. The display also includes a phosphor corresponding to a light source disposed on a back side of the semiconductor substrate opposite to the light source. IR light emitted from the light source is transmitted through the semiconductor substrate to illuminate the phosphor. Additional features and benefits of the present invention will become apparent from the detailed description, figures and claims set forth below.

BRIEF DESCRIPTION OF THE DRAWINGS

The present invention is illustrated by way of example and not limitation in the accompanying figures.

DETAILED DESCRIPTION

A method and an apparatus for displaying information with an integrated circuit device is disclosed. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the present invention, a through-semiconductor substrate display device is disclosed as an alternative to present day CRTs or flat panel display devices such as liquid crystal, plasma, field emission, electro-luminescent displays, or the like. The present invention utilizes conventional semiconductor processing techniques with inexpensive flip-chip or controlled collapse chip connection (C4) packaging. In one embodiment, the present invention may be utilized to implement a two-dimensional display suitable for use as an electronic or computer display device.

Figure 1:
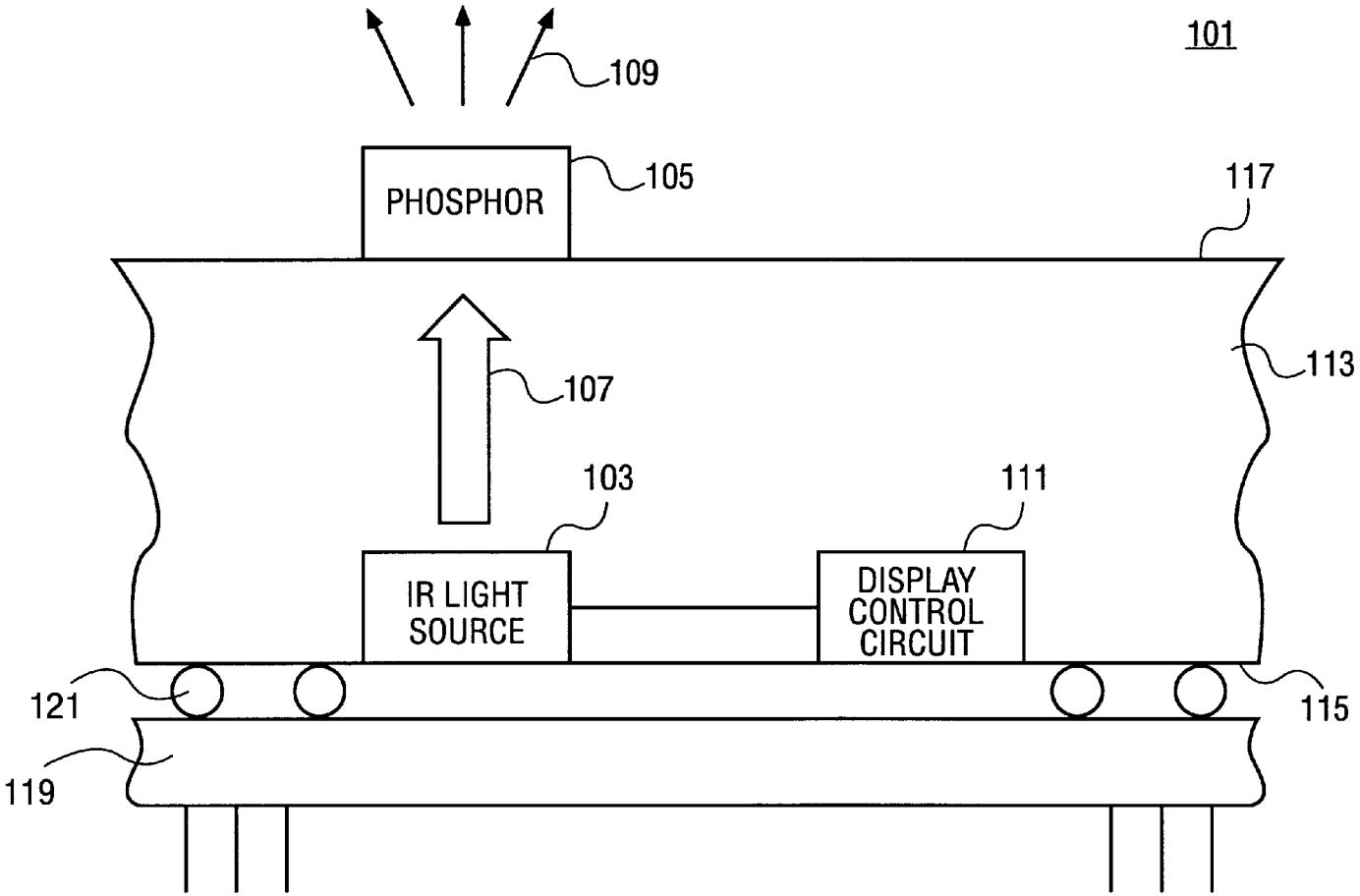
FIG. 1 is a block diagram of a cross section of one embodiment of a flip-chip packaged integrated circuit display in accordance with the teachings of the present invention.

FIG. 1 is a block diagram of one embodiment of an integrated circuit display device 101 in accordance with the teachings of the present invention. Integrated circuit display device 101 includes and infra red (IR) light source 103 built in to a front side 115 of a semiconductor substrate 113 of integrated circuit display device 101. In one embodiment, light source 103 emits a light beam 107 in response to display control circuit 111. In one embodiment, light source 103 includes a light emitting diode (LED) that emits IR light directly. As will be discussed, in another embodiment, light source 103 includes a known micro-mechanical or electro-optical shutter that is employed to modulate an external source (not shown) of IR light.

In one embodiment, light beam 107 is IR light and semiconductor substrate 113 is at least partially transparent to IR light. In one embodiment, semiconductor substrate 113 includes an IR or near-IR transparent semiconductor material such as for example gallium arsenide (GaAs), silicon (Si) or the like. Thus, light beam 107 is transmitted from light source 103 from front side 115 through semiconductor substrate 113 to a back side 117 of semiconductor substrate 113.

As shown in FIG. 1, integrated circuit display device 101 also includes a phosphor 105 corresponding to light source 103. In one embodiment, phosphor 105 is disposed on back side 117 of semiconductor substrate 113 such that phosphor 105 is optically coupled to light source 103 via light beam 107. In one embodiment, phosphor 105 up-converts the IR light of light beam 107 to visible light 109. Since phosphor 105 is therefore illuminated in response to light beam 107, an integrated circuit display device 101 is realized and information can be viewed accordingly.

As shown in FIG. 1, integrated circuit device 101 is included in a flip-chip packaged device as illustrated with semiconductor substrate 113 being coupled to package 119 from back side 115 through ball bond contacts 121. By using well-known and inexpensive flip-chip packaging techniques, conventional semiconductor processing techniques may be used to implement integrated circuit device 101 in accordance with the teachings of the present invention. Since conventional semiconductor processing techniques may be used, a display device in accordance with the teachings of the present invention may be implemented at relatively low cost.

In one embodiment, display control circuit 111 includes driver circuitry, decode logic, color correction tables, memory and the like to control light source 103. By including these elements within integrated circuit display device 101, the external component count is reduced. In one embodiment, a memory cell and local driver is associated with each light source 103 to render the integrated circuit display device 101 either fully or pseudo-static, thereby reducing the bandwidth requirements to update the display.

Figure 2:
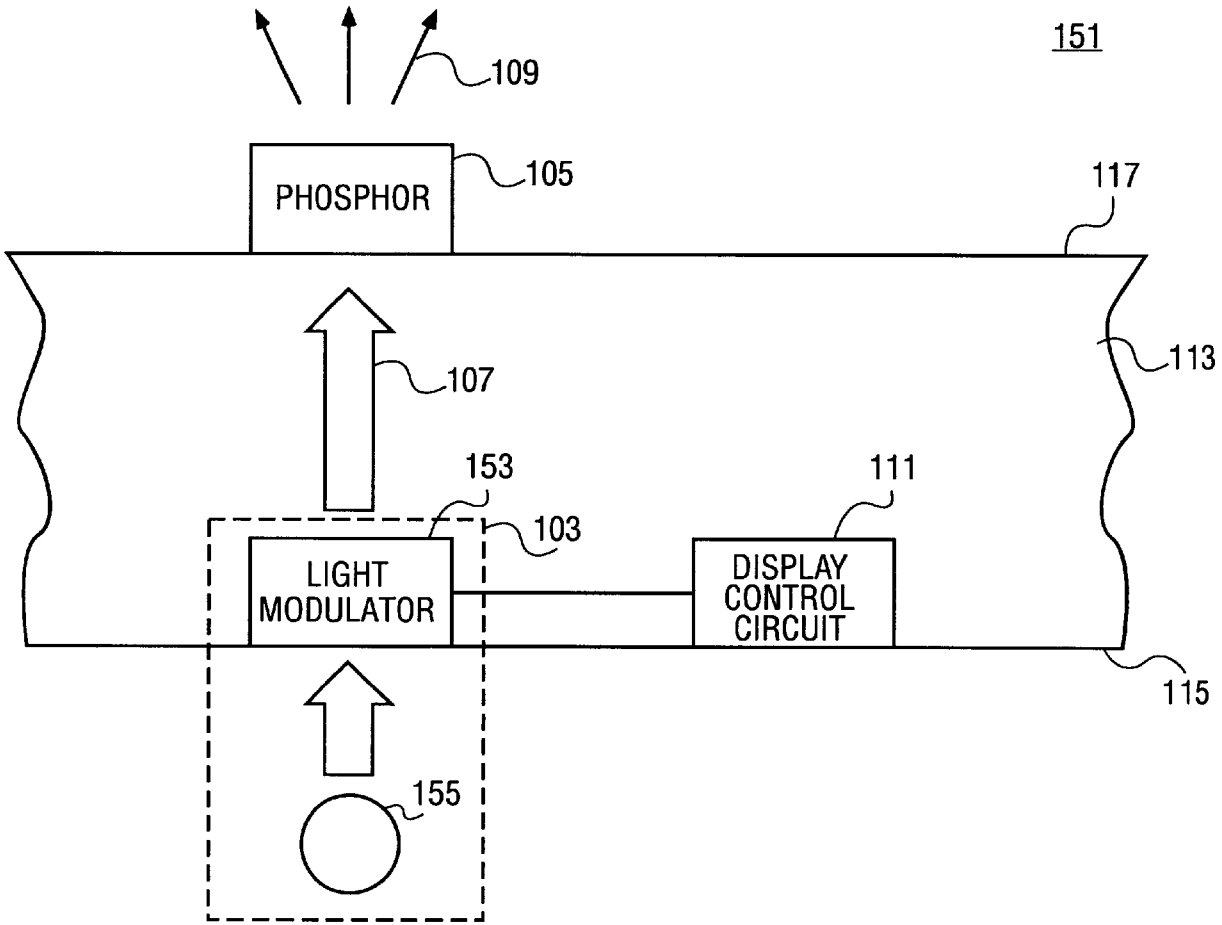
FIG. 2 is a block diagram of a cross section of another embodiment of a flip-chip packaged integrated circuit display in accordance with the teachings of the present invention.

FIG. 2 is a block diagram of another embodiment of an integrated circuit display device 151 in accordance with the teachings of the present invention. Integrated circuit display device 151 is similar to integrated circuit display device 101 as it includes phosphor 105 disposed on back side 117 of semiconductor substrate 113. Display control circuit 111 is coupled to IR light source 103, which is disposed on the front side 115 of semiconductor substrate 113.

In the embodiment illustrated in FIG. 2, light source 103 includes a light modulator 153 disposed in the front side 115 and an external light source 155 configured to provide IR light 107. In one embodiment, light modulator 153 utilizes known micro-mechanical or electro-optical shutter techniques to modulate light beam 107. IR light 107 is transmitted through the light modulator 153 and through the semiconductor substrate 113 to illuminate the phosphor 105. In one embodiment, it is noted that external light source 155 may be utilized to provide light for a plurality of light modulators 153.

Figure 3:
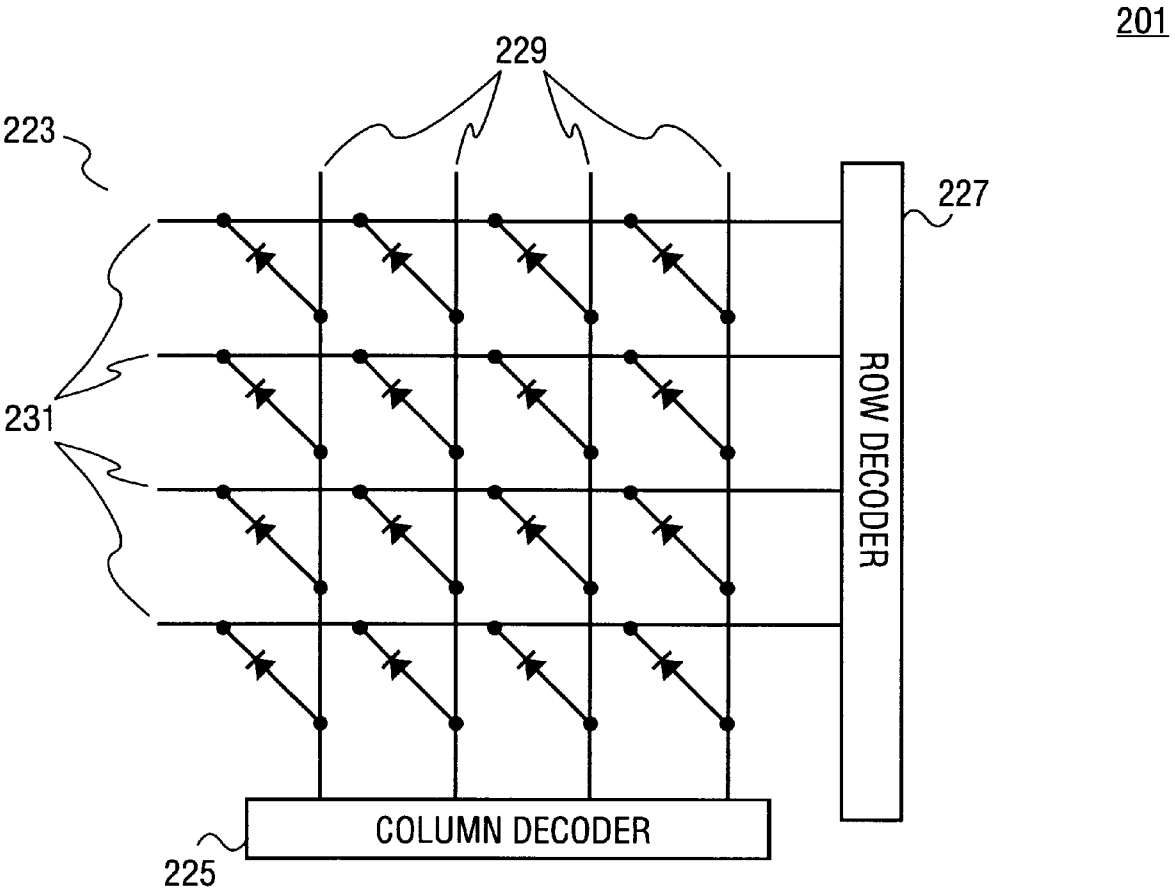
FIG. 3 is a schematic of one embodiment of an array of light emitting diodes with column decoder and row decoder in accordance with the teachings of the present invention.

FIG. 3 is a schematic showing another embodiment of an integrated circuit display device 201 in accordance with the teachings of the present invention. In one embodiment, a two-dimensional array of LEDs is arranged as shown in FIG. 3. In one embodiment, a GaAs wafer is utilized as a semiconductor substrate. In one embodiment, the source of IR light includes two-dimensional array 223 of GaAs:Si PN junctions arranged in a fashion similar to a memory array. In one embodiment, two-dimensional array 223 includes a plurality of column lines 229 coupled to a column decoder 225. In addition, two-dimensional array 223 includes a plurality of row lines 231 coupled to a row decoder 227. As illustrated in FIG. 3, each LED of two-dimensional array 223 is coupled between one of the row lines 231 and one of the column lines 229. In one embodiment, column decoder 225 and row decoder 227 selectively activate and deactivate column lines 229 and row lines 231 to selectively illuminate each one of the LEDs in two-dimensional array 223 to produce a two-dimensional image with integrated circuit device 201.

Figure 4:
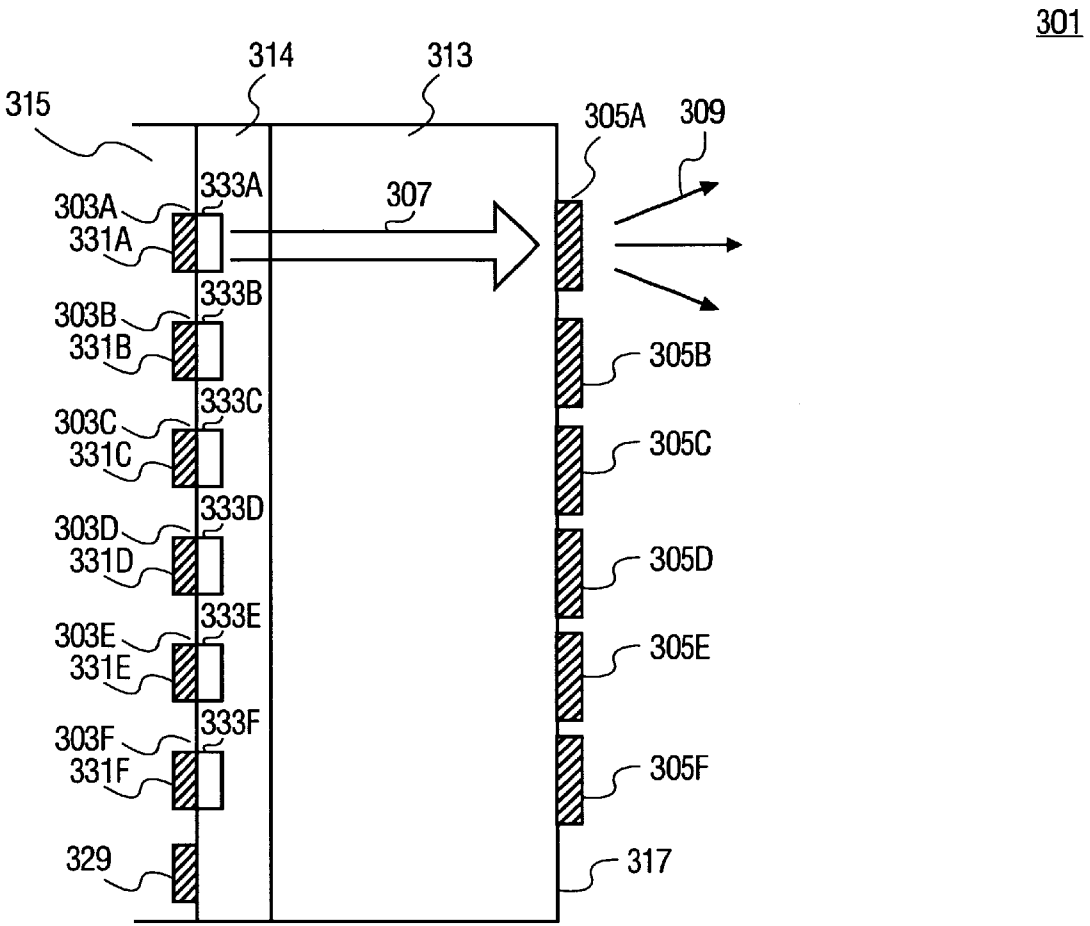
FIG. 4 is a cross section of another embodiment of an integrated circuit display in accordance with the teachings of the present invention.

FIG. 4 is a cross section of an integrated circuit display device 301 showing greater detail of the integrated circuit display device illustrated in FIG. 3. In particular, the two-dimensional array of LEDs is illustrated in FIG. 4 with LEDs 303A-F disposed in a front side 315 of semiconductor substrate 313. As shown in FIG. 4, LEDs 303A-F include PN junctions formed with P diffusions 333A-F of LEDs 303A-F disposed in N diffusion 314 of semiconductor substrate 313.

In one embodiment, column line 329 and row lines 331 A-F are also disposed on back side 315 of integrated circuit display device 301. In one embodiment, row lines 331 A-F are coupled to LEDs 303A-F, respectively. In one embodiment, column line 329 and row lines 331 A-F are included in a metal layer of integrated circuit device 301 to reflect IR light from front side 315. In one embodiment, semiconductor substrate 313 includes gallium arsenide and LEDs 303A-F are formed with GaAs:Si PN junctions. In one embodiment, LEDs 303A-F radiate light at a wavelength of approximately 950 nm, which is well below the bandgap of GaAs. FIG. 4 shows a light beam 307 being emitted from LED 303A from front side 315 through semiconductor substrate 313 to back side 317 of integrated circuit display device 301.

In one embodiment, a two-dimensional array of phosphors is patterned on back side 317 of semiconductor substrate. The two-dimensional array of phosphors patterned on back side 317 is illustrated in FIG. 4 as phosphors 305A-F. As shown in FIG. 4, each of the phosphors 305A-F of the two-dimensional array of phosphors correspond to one of the LEDs 303A-F of the two-dimensional array of LEDs. In one embodiment, each LED on front side 315 illuminates a corresponding phosphor on back side 317. Indeed, as shown in FIG. 4, LED 303A emits light beam 307 from front side 315 through semiconductor substrate 313 to back side 317 to illuminate phosphor 305A, which emits visible light 309 in response thereto.

In one embodiment, phosphors 305A-F emit various patterns of visible light 309 to produce images that can be viewed from back side 317. In one embodiment, all of phosphors 305A-F are of a single phosphor type such that a monochrome display is viewed from back side 317. In another embodiment, phosphors 305A-F include phosphors that up-convert IR radiation to red light, green light and blue light. In one embodiment, phosphors 305A and 305D convert IR light to red light, phosphors 305B and 305E convert IR light to green light and phosphors 305C and 305F convert IR light to blue light. Thus, in this embodiment, a color display is realized with integrated circuit display device 301 as a full color image can be viewed from back side 317.

Figure 5:
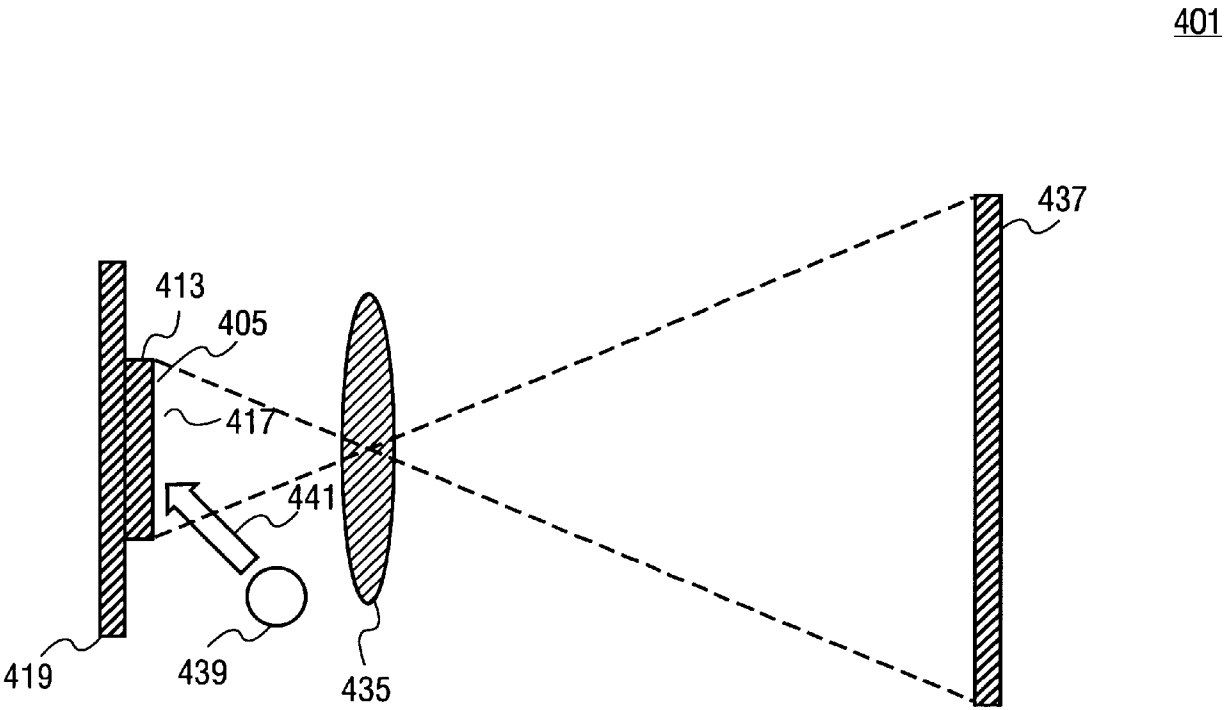
FIG. 5 is a block diagram of yet another embodiment of an integrated circuit display device display in accordance with the teachings of the present invention.

FIG. 5 is a block diagram of another embodiment of an integrated circuit display device 401 in accordance with the teachings of the present invention. In particular, FIG. 5 shows an integrated circuit 413 mounted on a flip chip package 419. In one embodiment, integrated circuit 413 is similar to the integrated circuit devices discussed above with reference to FIGS. 1–3. An image produced by a two-dimensional array of phosphors patterned on a back side 417 of integrated circuit 413 is focused through a lens 435 onto a relatively larger view screen 437. Thus, in one embodiment, the image produced on back side 417 of integrated circuit 413 is enlarged when viewed through view screen 437 in accordance with the teachings of the present invention. Thus, in one embodiment, even though integrated circuit 413 may be relatively small for a display device, view screen 437 may be relatively large in comparison and produce a much larger image for display.

In one embodiment, the two-dimensional array of phosphors 413 includes known anti-stokes type phosphors, which do not require periodic refreshing from an ultraviolet source. In another embodiment, the two-dimensional array of phosphors 413 includes known phosphors that require a periodic refresh of ultraviolet light. In such an embodiment, an ultraviolet flash lamp 439 is optically coupled to phosphors 413, as shown in FIG. 5, to provide ultraviolet light 441 to refresh phosphors 413 from time to time.

Thus, what has been described is an integrated circuit display device that can be implemented using conventional semiconductor processing techniques. It is noted that the integrated circuit display device of the present invention is scalable in resolution and may therefore enable higher resolutions with advancements and semiconductor processing capabilities. It is appreciated that since the integrated circuit display device of the present invention utilizes conventional semiconductor processing techniques, the display device of the present invention may be relatively inexpensive to manufacture.

In the foregoing detailed description, the method and apparatus of the present invention has been described with reference to specific exemplary embodiments thereof. However, it will be evident that various modifications and changes may be made thereto without departing from the broader spirit and scope of the present invention. The present specification and figures are accordingly to be regarded as illustrative rather than restrictive.

What is claimed is:

1. A display, comprising:

an infra red (IR) light source disposed on a front side of a semiconductor substrate of an integrated circuit; and a phosphor corresponding to the light source, the phosphor disposed on a back side of the semiconductor substrate opposite to the light source such that IR light emitted from the light source is transmitted through the semiconductor substrate to illuminate the phosphor.

2. The display of claim 1 wherein the IR light source is included in a plurality of IR light sources arranged in a first two-dimensional array disposed on the front side of the semiconductor substrate.

3. The display of claim 2 wherein the phosphor is included in a plurality of phosphors arranged in a second two-dimensional array disposed on the back side of the semiconductor substrate opposite to the plurality of light sources such that IR light emitted from each one of the light sources is transmitted through the semiconductor substrate to illuminate a corresponding one of the plurality of phosphors.

4. The display of claim 3 wherein a first portion of the plurality of phosphors comprise phosphors that up-convert the IR light to red visible light, wherein a second portion of the plurality of phosphors comprise phosphors that up-convert the IR light to green visible light, and wherein a third portion of the plurality of phosphors comprise phosphors that up-convert the IR light to blue visible light.

5. The display of claim 1 wherein the light source comprises a light emitting diode (LED).

6. The display of claim 5 wherein the semiconductor substrate comprises silicon.

7. The display of claim 5 wherein the semiconductor substrate comprises gallium arsenide.

8. The display of claim 2 wherein the two-dimensional array of IR light sources is organized into a plurality of rows and a plurality of columns, the display further comprising:

a row decoder coupled to the plurality of rows of light sources; and a column decoder coupled to the plurality of columns of light sources;

wherein each one of the plurality of light sources is selectively activated in response to the row decoder and the column decoder.

9. The display of claim 1 further comprising:

a view screen; and a lens disposed between the view screen and the phosphor;

wherein the lens focuses light emitted from the phosphor on the view screen.

10. The display of claim 1 wherein the integrated circuit comprises a display control circuit to control the light source.

11. The display of claim 1 wherein the integrated circuit is included in a flip-chip packaged integrated circuit device.

12. The display of claim 1 wherein the light source comprises:

a light modulator disposed on the front side of the semiconductor substrate; and an external light source proximate to the light modulator such that the light emitted from the external light source is transmitted through the light modulator and through the semiconductor substrate to illuminate the phosphor.

13. The display of claim 1 further comprising an ultraviolet light source optically coupled to the phosphor, the ultraviolet light source configured to refresh the phosphor.

14. The display of claim 1 wherein the phosphor comprises an anti-stokes phosphor.

15. A method of displaying information, the method comprising the steps of:

generating an infra red (IR) light beam in response to the information from a light source disposed on a front side of a semiconductor substrate of an integrated circuit;

transmitting the IR light beam through the semiconductor substrate to a back side of the semiconductor substrate; and converting the IR light beam to visible light with a phosphor corresponding to the light source, the phosphor disposed on a back side of the semiconductor substrate opposite to the light source.

16. The method described in claim 15 including the additional steps of:

generating a plurality of infra red (IR) light beams in response to the information from a plurality of light sources arranged in a first two-dimensional array on the front side of a semiconductor substrate of an integrated circuit;

transmitting the plurality of IR light beams through the semiconductor substrate to the back side of the semiconductor substrate; and converting the plurality of IR light beams to visible light with a plurality of phosphors arranged in a second two-dimensional array on the back side of the semiconductor substrate opposite the plurality of light sources, each one of the plurality of phosphors corresponding to one of the plurality of light sources.

17. The method described in claim 16 wherein the step of converting the plurality of IR light beams to visible light with the plurality of phosphors comprise the steps of:

up-converting a first portion of the plurality of IR light beams to red light;

up-converting a second portion of the plurality of IR light beams to green light; and up-converting a third portion of the plurality of IR light beams to blue light.

18. The method described in claim 15 wherein the step of generating the IR light beam includes the step of generating the IR light beam with a light emitting diode (LED) disposed on the front side of the semiconductor substrate.

19. The method described in claim 18 including the additional step of controlling the LED with a display control circuit disposed in the integrated circuit.

20. The method described in claim 16 including the additional step of controlling the plurality of light sources with the display control circuit.

21. The method described in claim 16 including the additional steps:

controlling a plurality of rows of the first two-dimensional array with a row decoder circuit; and controlling a plurality of columns of the first two-dimensional array with a column decoder circuit.

22. The method described in claim 16 including the additional step of focusing an image formed by the second two-dimensional array through a lens onto a view screen, wherein the lens is disposed between the plurality of phosphors and the view screen such that the lens focuses light emitted from the plurality of phosphors onto the view screen.

23. The method described in claim 15 including the additional step of flip-chip packaging the integrated circuit.

24. A display, comprising:

a two-dimensional array of infra red (IR) light sources disposed on a front side of a semiconductor substrate; and a two-dimensional array of phosphors, each one of the phosphors corresponding to one the IR light sources, the two-dimensional array of phosphors disposed on a back side of the semiconductor substrate opposite to the two-dimensional array of IR light sources such that IR light emitted from each one of the light sources illuminates the corresponding one of the phosphors through the semiconductor substrate.

25. The display described in claim 24 wherein the two-dimensional array of IR light sources comprise a plurality of IR light emitting diodes.

26. The display described in claim 24 wherein the two-dimensional array of phosphors comprises:

a plurality of red up-converting phosphors;

a plurality of green up-converting phosphors; and a plurality of blue up-converting phosphors.

27. The display described in claim 24 wherein the semiconductor substrate comprises gallium arsenide.

28. The display described in claim 24 wherein the semiconductor substrate comprises silicon.

29. The display of claim 24 further comprising:

a row decoder coupled to a plurality of rows of the two-dimensional array of IR light sources; and a column decoder coupled to a plurality of columns of the two-dimensional array of IR light sources;

wherein each one of the plurality of IR light sources is selectively activated in response to the row decoder and the column decoder.

30. The display of claim 24 further comprising:

a view screen; and a lens disposed between the view screen and the two-dimensional array of phosphors;

wherein the lens focuses light emitted from the two-dimensional array of phosphors on the view screen.

* * * * *